APPARATUS FOR AUTOMATIC ARRANGEMENT OF MAH-JONGG TILES

The present invention relates to an apparatus for automatically arranging the Mah-Jongg tiles on a Mah-Jongg board, and more particularly to an apparatus for automatically arranging the Mah-Jongg tiles on a Mah-Jongg board in parallel with the four edges thereof so that four players can begin to play Mah-Jongg without going through the trouble of manually arranging the Mah-Jongg tiles.

It is an object of the present invention to provide an apparatus in which two horizontal rows of Mah-Jongg tiles are automatically formed at the starting point of a Mah-Jongg tile conveyor system incorporated in the apparatus.

It is another object of the present invention to provide an apparatus in which two horizontal rows of Mah-Jongg tiles are rearranged in two vertical tiers in the course of being thrusted forward in the Mah-Jongg tile conveyor system.

It is still another object of the present invention to provide an apparatus which is compact enough to be mounted on the under surface of a Mah-Jongg board.

With these objects in view which will become apparent from the following detailed description, the present invention will be more clearly understood in connection with the accompanying drawings, in which:

FIG. 1 is a vertical section of an apparatus according to the present invention;

FIG. 2 is a plan view thereof;

FIG. 3 is an enlarged plan view of a Mah-Jongg tile supply system incorporated in the apparatus;

FIG. 4 is a vertical section of said system;

FIG. 5 is a perspective view thereof;

FIG. 6 is a perspective view of the last portion of the Mah-Jongg tile conveyor system in which Mah-Jongg tiles arranged in two horizontal rows are being rearranged in two vertical tiers;

FIG. 7 is a perspective view showing two vertical tiers of Mah-Jongg tiles coming up to the surface of the Mah-Jongg board;

FIG. 8 is a perspective view showing two vertical tiers of Mah-Jongg tiles made ready for the start of play; and FIGS. 9*a* to 9*e* are cross-sectional views showing the sequent order in which Mah-Jongg tiles arranged in two horizontal rows are rearranged in two vertical tiers.

Referring now to FIGS. 1 and 2, an apparatus in accordance with the present invention includes a Mah-Jongg board 2 provided with four rectangular openings 3 in the proximity of four edges of the board 2, respectively, in such a manner that the longitudinal edges of each rectangular opening 3 run parallel to each edge of the board 2. Each opening 3 has such dimensions that two vertical tiers of Mah-Jongg tiles, with each tier consisting of seventeen Mah-Jongg tiles A and with the longitudinal axis of each Mah-Jongg tile A placed perpendicularly to the edge of the board 2, can barely pass therethrough. A rectangular board 4, which fits in each opening 3 and is adapted to turn on a hinge 19 provided on one of the transverse edges thereof, is urged downwardly by a tension coil spring 35.

The apparatus for conveying and arranging the Mah-Jongg tiles is generally designated by the numeral 5. A unit of the apparatus 5, which is held between two side plates 6*a* and 6*b*, is installed under each opening 3 in such a manner that the side plates 6*a* and 6*b* run parallel to the longitudinal edges of the opening 3. The space left between the side plates 6*a* and 6*b* is just enough to allow two horizontal rows of Mah-Jongg tiles A to barely pass therethrough, with the longitudinal axis of each Mah-Jongg tile A placed perpendicularly to the side plates 6*a* and 6*b*.

The apparatus 5 includes three pulleys 8, 11 and 12. Of these three pulleys, the pulley 8 is placed in the remotest position from the hinge 19. The pulley 11 is placed in the lower part of the space between the side plates 6*a* and 6*b* in the proximity of the vertical edges thereof that are nearer to the hinge 19, while the pulley 12 is placed directly under one of the transverse edges of the opening 3 which is not provided with the hinge 19. The pulley 8 is driven by a motor 9 mounted on the side plate 6*a* so as to allow an endless belt 7 to run in the grooves provided in the rims of the pulleys 8, 11 and 12.

The edges of the side plates 6*a* and 6*b* are joined by a guide plate 10 which serves for guiding the Mah-Jongg tiles A from a Mah-Jongg tile supply system 20 to the opening 3. The guide plate 10 partially surrounds the endless belt 7 in such a manner that one end of the guide plate 10 terminates directly under the pulley 11 and is provided with the Mah-Jongg tile supply system 20, while the other end of the guide plate 10 terminates over the pulley 8. The guide plate 10 comprises a straight portion 10*a* which runs parallel to the endless belt 7 at the interval between the pulleys 11 and 8, and a substantially semicircular portion 10*b* which is adjoined to the portion 10*a* and surrounds nearly half of the pulley 8 concentrically therewith.

The straight portion 10*a* is just long enough to allow thirty-four Mah-Jongg tiles A to be arranged in two horizontal rows so that each row may consist of seventeen Mah-Jongg tiles A, with the longitudinal axis of each Mah-Jongg tile A placed perpendicularly to the running direction of the endless belt 7 as shown in FIG. 5.

In the course of passage through the semicircular portion 10*b*, two horizontal rows of the Mah-Jongg tiles A thrusted thereinto from the straight portion 10*a* are allowed to turn upside down. For this purpose, guide rails 14 and 15 are fixed to the side plates 6*a* and 6*b*, respectively. In the region surrounded by the semicircular portion 10*b*, the guide rails 14 and 15 are concentric with the pulley 8, and a space substantially equal to the thickness of a Mah-Jongg tile A is left between these guide rails and the semicircular portion 10*b* of the guide plate 10.

Referring now to FIGS. 6 and 9, the last portion of the Mah-Jongg tile conveyor system, which is adjoined to the portion 10*b*, is generally designated by the numeral 13. The guide rail 14 extends straightforward throughout the portion 13. By means of a guide 16 provided on the guide rail 14 at the end of the portion 13, the Mah-Jongg tiles A sliding on the guide rail 14 while keeping in touch with the side plate 6*a* are deflected toward the center between the side plates 6*a* and 6*b* and supported by an auxiliary guide rail 17 which is provided on the side plate 6*b* on the same level with the guide rail 14.

The guide rail 15 forms a gradual ascent in relation to the guide rail 14 until the difference of altitude between the guide rails 14 and 15 comes to be substantially equal to the thickness of the Mah-Jongg tiles A. By means of a guide 18 provided on the guide rail 15 at the end of the portion 13, the Mah-Jongg tiles A sliding on the guide

BOARD RACING GAME APPARATUS

TECHNICAL FIELD

This invention relates generally to an apparatus for playing a board racing game, more particularly to an apparatus for playing an automotive board racing game, and even more particularly to a stock car-style board racing game apparatus.

BACKGROUND ART

Board racing games, in particular automotive board racing games, are known in the prior art, with U.S. Pat. No. 1,148,737 to Atkins, U.S. Pat. No. 1,523,242 to Bain, U.S. Pat. No. 2,577,961 to Graves, U.S. Pat. No. 3,044,779 to Hvizdash, U.S. Pat. No. 3,231,279 to Howarth et al, and U.S. Pat. No. 3,462,152 to Royston being exemplary thereof.

This and other prior art of which I am aware fails to provide for lane changing on the straightaways by which a driver may maneuver his vehicle into the race track "groove". Illustrative of this type of prior art is Howarth et al, which does provide for lane changing, but only in the area of the turns. Additionally, the prior art of which I am aware does not provide for a lane into pit areas; does not control movement from race track to the pit area lane; does not provide for stock car-style positioning of vehicles at the start line; and does not provide a stock car-style board racing game having a preferred route around the race track.

SUMMARY OF THE INVENTION

It is accordingly one object of the present invention to provide a board racing game providing for lane changing on the straightaways whereby a driver may maneuver his vehicle into the race track "groove".

It is a further object of the present invention to provide a board racing game having a lane into pit areas.

It is a still further object of the present invention to control movement from the race track to the pit area lane.

It is an additional object of the present invention to provide a board racing game having stock car-style positioning of vehicles at the start line.

It is an even additional object of the present invention to provide a stock car-style board racing game having a preferred route around the race track.

Other objects and advantages of the present invention will become apparent as the description thereof proceeds.

In satisfaction of the foregoing objects and advantages, there is provided a board racing game apparatus including playing pieces and a board having a plurality of marked spaces forming a continuous track. The continuous track has a plurality of divisions or lanes throughout its length. The marked spaces constitute a plurality of groups distinguishable one from another. One of these groups provides a preferred route around the continuous track. Certain of the spaces in another of these groups provide for unrestricted movement from lane to lane. A third group affects movement on the course. The board has an additional plurality of marked spaces that form at least one second course partially extending about the board. This second course is contiguous with the continuous track and provides for movement off and back onto the continuous track.

In the description of the drawing and in the detailed description of the invention which follows, I have shown and essentially described only the preferred embodiment of my invention, simply by way of illustration of the best mode contemplated by me of carrying out my invention. As will be realized, the invention is capable of other and different embodiments, and its several details are capable of modifications in several respects, all without departing from the invention. Accordingly, the drawing and following description are to be regarded as illustrative in nature, and not as restrictive.

BEST MODE FOR CARRYING OUT THE INVENTION

Figure 1:
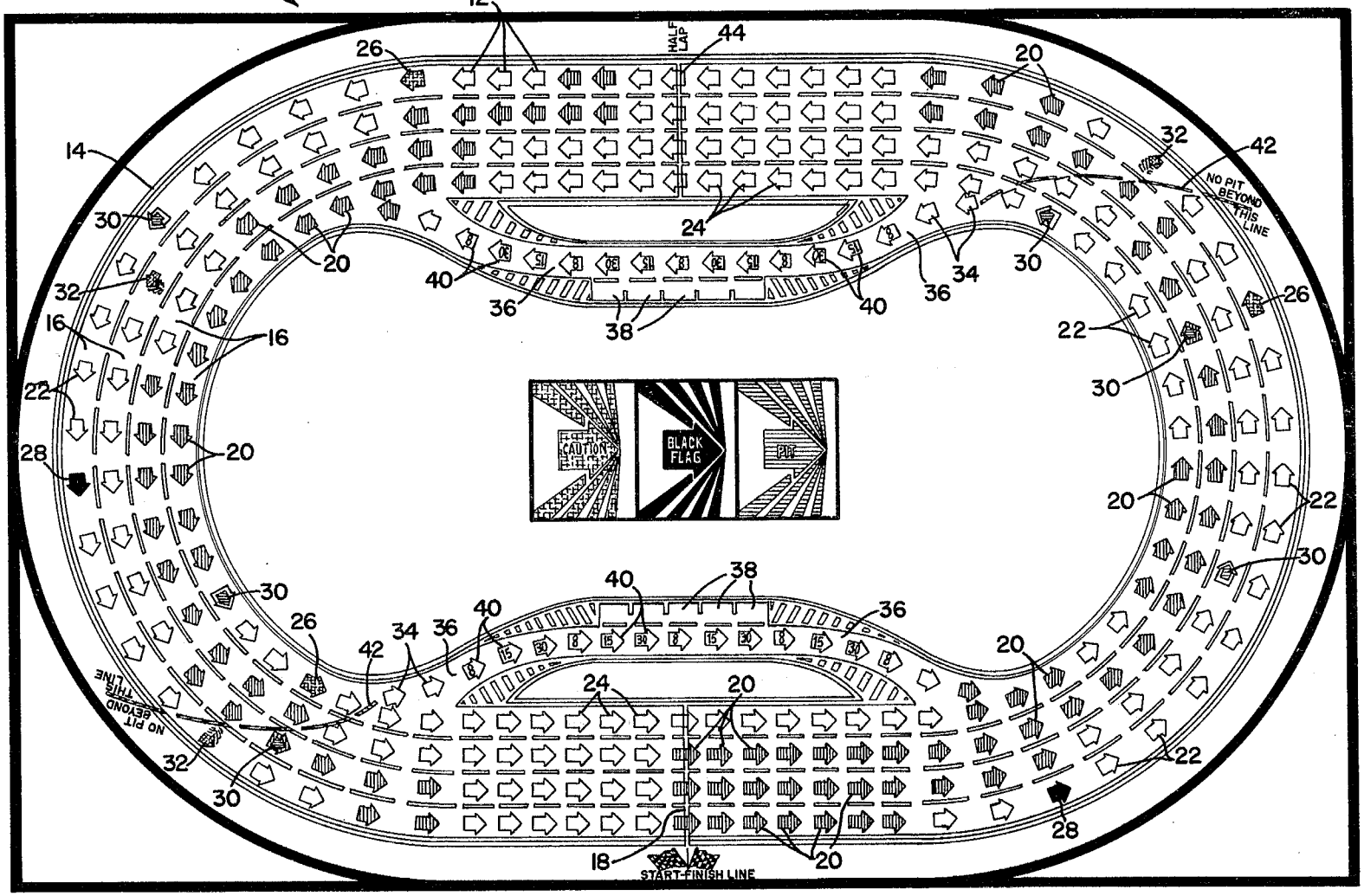
FIG. 1 is a plan view of a game board according to the present invention.
Figure 2:
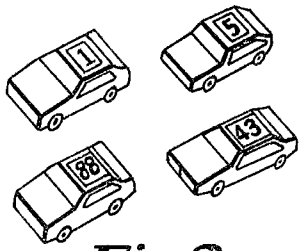
FIG. 2 is a perspective view of several automobile playing pieces according to the present invention.
Figure 6:
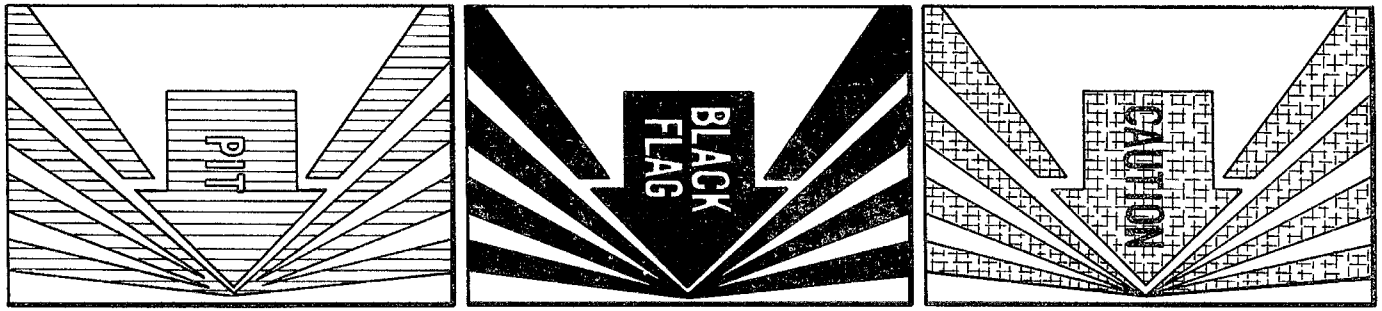
FIGS. 6 and 7 are plan views of cards according to the present invention, with FIG. 6 showing the top side of a Caution card, a Black Flag card, and a Pit card, and FIG. 7 showing representative direction sides; the direction sides in FIG. 7 being directly below the corresponding top side shown in FIG. 6.
Figure 7:
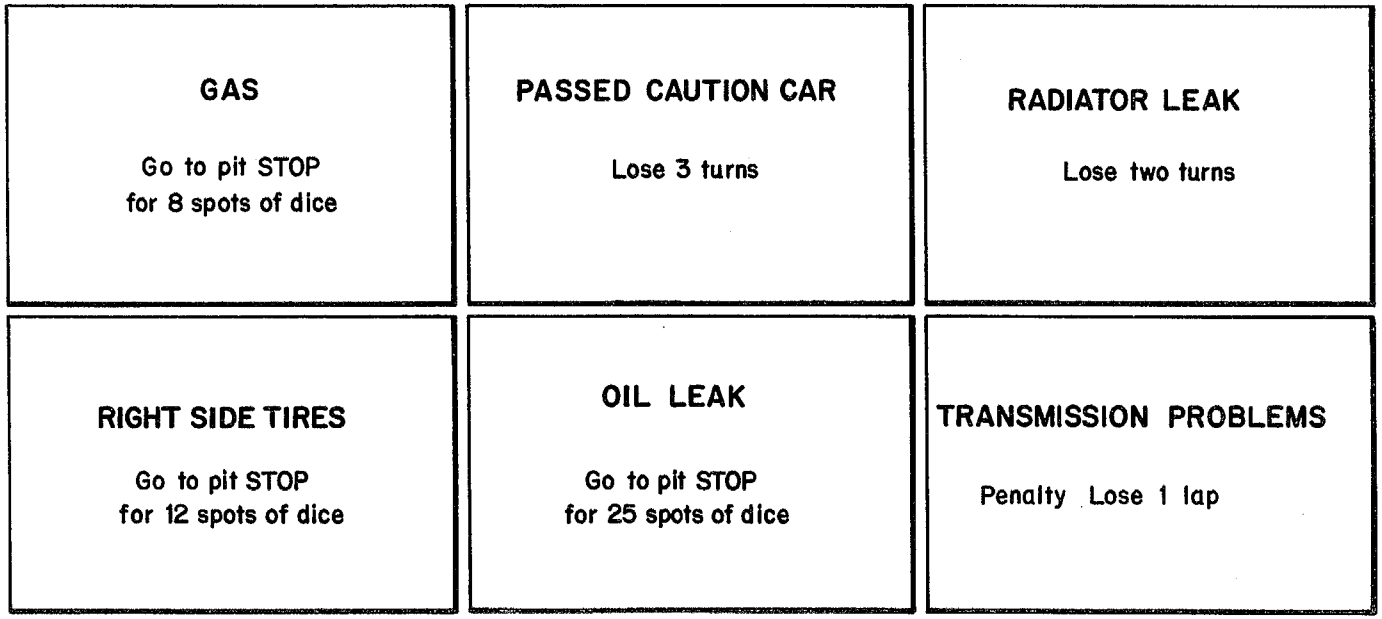

Referring to FIG. 1, a game board 10 has a plurality of arrows 12 that form a continuous track 14 divided into lanes 16. Track 14 has start-finish line 18. Arrows 12 form several groups distinguishable from one another by color. In the following description, exemplary colors are assigned to these several groups. Red arrows 20 provide a preferred route around continuous track 14. This route is the "groove" or fastest line on the track 14. Uncolored or open arrows 22 provide a non-preferred route around track 14. Uncolored or open arrows 24 permit lane changing on the straightaways of track 14. Yellow arrows 26, black arrows 28, blue arrows 30 and orange, curving arrows 32 affect movement on track 14 when an automobile (shown in FIG. 2) comes to rest on one of these arrows. The yellow, black and blue arrows result in the drawing of a card corresponding in color to the arrow color. Examples of these cards are shown in FIGS. 6 and 7. These cards indicate racing problems. A yellow arrow results in a yellow Caution card being drawn, a black arrow causes a Black Flag card to be drawn, and a blue arrow causes a blue Pit card to be drawn. The orange, curving arrows indicate that a spin-out has occurred.

Game board 10 has an additional plurality of arrows 34 that form two pit stop lanes 36, which are contiguous with track 14 and provide for movement off and back onto track 14. Adjacent to pit stop lanes 36 are a plurality of pit stop areas 38. Numbered arrows 40 in lanes 36 affect the duration of a pit stop. Indicator lines 42 control movement from track 14 to lanes 36.

The location of red arrows 20 simulates the racing "groove" on an actual race track. The superimposition of yellow arrows 26, black arrows 28, blue arrows 30 and orange arrows 32 on certain of uncolored or open arrows 22 simulates the unpreferred route around an actual race track. Arrows 24 are also realistically positioned. The location of indicator line 42 simulates the position beyond which movement cannot be made safely from an actual race track to the pits.

Game board 10 has half-lap line 44.

Figure 3:
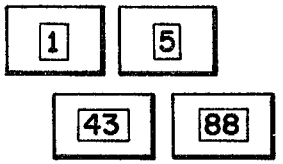
FIG. 3 is a plan view of several pit marker playing pieces according to the present invention.

Prior to beginning the race, each driver selects an automobile (shown in FIG. 2) and a matching pit marker (shown in FIG. 3), and the participating drivers decide the number of laps to be covered and the number of scheduled pit stops. When pit stops are scheduled every four or five laps, the racing is kept close. From two to ten drivers may race, and when four or five drivers decide upon a ten lap race with two scheduled pit stops, the race takes about one hour.

Qualification for starting position may be done in either of two ways. One way of qualifying is for each driver to roll the dice once, with the driver with the highest total winning pole position, the driver with the second highest total winning second position and so forth. The other way of qualifying is for each driver to place his car on half-lap line 44 and race to start-finish line 18. In this qualifying race, one driver rolls the dice, moves his car one arrow for each spot on the dice, and continues to do so until start-finish line 18 is reached. The number of dice throws required for the driver to reach line 18 is recorded. Each of the other drivers then qualifies in turn in this manner. The driver requiring the fewest throws of the dice wins the pole position, with the driver requiring the second fewest number of throws winning the second position, and so forth. If two or more drivers require the same number of dice throws, they may either run another qualifying half lap or roll the dice for the highest total.

The driver qualifying for pole position places his car on start-finish line 18 on the red arrow closset to the inside of track 14. The second fastest qualifier positions his car beside the pole winner, and the remaining qualifiers line up two by two behind the first two qualifiers according to their relative qualifying positions. At this point each driver selects a pit stop area 38 and places his pit marker on the selected pit area.

The race is begun by each driver, beginning with the pole sitter and working through the field in order, rolling the dice and moving his car one arrow for each spot on the dice. The order of rolling the dice remains the same throughout the race. In the event a driver rolls the dice out of turn, he is penalized by his car being moved back ten arrows. If a driver rolls "doubles" on the dice, he gets another roll.

When a car is on one of the uncolored or open arrows 24 on the straightaways, the driver may freely change lanes in order to position the car to enter the "groove". Otherwise, a car must remain in its lane except to pass a car blocking its forward movement. Passing is accomplished either by moving to the right or the left lane. If a car remains in the "groove", that is, on a red arrow, during passing, the driver may return to the lane from which he began to pass. However, if a car leaves the "groove" while passing, the car must remain outside the "groove" until the straightaway is reached, at which time the driver may change lanes so as to re-enter the "groove". In the event that the lane in which a car is located and the adjacent lanes on each side of this lane are blocked by other cars, the driver must wait for the blocking car(s) to move. However, the driver may advance his car to a position immediately behind the car blocking his lane.

When a car stops on a yellow arrow 26, a black arrow 28 or a blue arrow 30, the driver draws a card of the same color and follows the instructions on the card. If a pit stop is called for by the card, the driver proceeds as quickly as possible to his pre-selected pit area and remains there for the required duration of this unscheduled pit stop. Once the unscheduled pit stop is completed, the driver resumes the race.

Figure 4:
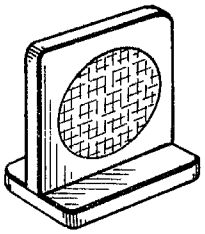
FIG. 4 is a perspective view of the caution marker playing piece according to the present invention.
Figure 5:
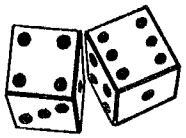
FIG. 5 is a perspective view of the dice used to determine the extent of the move of a car over the track.

When a card is drawn that is marked "caution" on its direction side, the Caution marker (FIG. 4) is placed on the track. The racing leader at the time this card is drawn must, as soon as he reaches one of lines 18 or 44, use only one of the dice for the next half lap. The other drivers use both dice, but cannot pass the leader, only draw nearer to him. In the event one of the other drivers does pass the leader while the Caution marker is in effect, the violating driver must move his car back thirty arrows. While the Caution marker is in effect, it is advantageous to make a scheduled pit stop. If the leader makes a pit stop while the Caution marker is in effect, the second place car becomes the leader and its driver must throw only one of the dice for the remainder of the half lap that he is in. A leader making a pit stop at the time the Caution marker is in effect, continues to use only one of the dice until the new leader finishes the remainder of the half lap he is in.

During the time that the racing leader is completing the half lap under caution, a driver is excused from drawing a card if his car comes to rest on a yellow, black or blue arrow. Also, a driver who has drawn one card and has not completed the prescribed penalty is excused from drawing another card if his car comes to rest on a yellow, black or blue arrow. Furthermore, once the leader begins the final lap, each driver is excused from drawing a card if his car comes to rest upon a yellow, black or blue arrow.

A driver whose car comes to rest on orange, curving arrow 32, which represents a spin-out, loses one turn. This turn is lost even if the last lap has begun.

A pit stop may be scheduled or unscheduled. The number of scheduled pit stops is determined prior to beginning the race, whereas unscheduled pit stops may result from a car coming to rest on a yellow, black or blue arrow. In making a pit stop a driver is to follow the arrows to his preselected pit area. A driver may not enter pit stop lane 36 from past indicator line 42. The duration of stay in the pits is determined on a scheduled pit stop as follows: if the car comes to rest on a numbered arrow 40 in lane 36, the indicated number plus the number of arrows remaining to the pre-selected pit area determines the duration of the stop. Thus, landing on an arrow with the number fifteen on it, when this arrow is three arrows away from the pre-selected pit area, results in a pit stop for eighteen spots on the dice.

In an unscheduled pit stop, the card requiring movement into pit lane 36 may or may not prescribe the duration of the pit stop. If the drawn card does prescribe the duration of the pit stop, the above method for determining the length of a scheduled pit stop does not apply. However, if the drawn card does not prescribe the duration of the stop, the duration is determined just as if it were a scheduled stop.

Once a driver is in pit lane 36 and the duration of the pit stop has been determined, the driver rolls the dice on each of his turns until the total number of spots necessary to leave the pits has been rolled. Any spots in excess of the number regulating the duration of the stop are used for moving from the lane 36 back onto track 14.

The first driver to complete the total number of laps and scheduled pit stops is the winner. If two or more drivers cross start-finish line 18 on the same turn, the winner is the first to do so. A driver in the pit area adjacent start-finish line 18 may exit from the pit area after completion of the pit stop, and be the winner if the driver enters the pit area on his last lap and has completed all scheduled pit stops.

I claim:

1. A board racing game apparatus comprising:

(a) a plurality of playing pieces, and (b) a board acting as a playing field having a plurality of directively marked spaces constituting a first course extending about the board, said course affording a continuous track and said course having a plurality of divisions throughout its length; said marked spaces constituting a plurality of distinguishable groups, with a first distinguishable group providing a first route around the course, with a second distinguishable group providing a second route around the course, and with a third distinguishable group affecting movement on the course, said first course bearing fewer of said third distinguishable group than said second course; said board having an additional plurality of directively marked spaces constituting at least one second course partially extending about the board, said second course being contiguous with said first course and providing for movement off and back onto said first course; and said board having at least one line restricting movement off said first course onto said second course, said line extending across said plurality of divisions;

wherein said playing pieces constitute a plurality of distinguishable playing piece groups, with the playing pieces in a first playing piece group being adapted to be moved along said first and second courses; wherein said second course has a plurality of stop areas adjacent thereto, and wherein the playing pieces in a second playing piece group are adapted to be positioned in said plurality of stop areas, prior to beginning movement of the playing pieces of said first playing piece group around said first and second courses; each playing piece in said first playing piece group forming a distinguishable group with one playing piece in said second playing piece group.

2. The apparatus of claim 1 further comprising at least one set of cards affecting movement on the course, wherein certain of the marked spaces constituting said third distinguishable group generate the drawing of a card to determine the particular movement effect.

3. The apparatus of claim 1 wherein one of said plurality of distinguishable playing piece groups comprises a type of playing piece that limits the movement of certain of the playing pieces in said first playing piece group.

4. The apparatus of claim 1 wherein said first course has an oval configuration.

5. The apparatus of claim 1 wherein said playing pieces comprise vehicles, wherein said board is a vehicle racing track, and wherein said first course has straightaways and turns.

6. The apparatus of claim 5 wherein said certain spaces of said second distinguishable group are located on said straightaways.

7. The apparatus of claim 5 wherein said second course is a pit stop lane adjacent to which is a plurality of pit stop areas.

8. The apparatus of claim 5 wherein the preferred route provided by the first distinguishable group of marked spaces simulates the racing groove on an actual race track.

9. The apparatus of claim 1 wherein certain of said additional plurality of directively marked spaces bear indicia for selectively affecting the duration of a stop in said plurality of stop areas.

10. The apparatus of claim 9 wherein said certain of said additional plurality of directively marked spaces bear numbers.

11. The board game apparatus of claim 1 wherein only certain of said additional plurality of directively marked spaces bear indicia for affecting the duration of a stop in said plurality of stop areas; and wherein one of said plurality of distinguishable playing piece groups comprises a type of playing piece that limits the movement of certain of the playing pieces in said first playing piece group.

12. The apparatus of claim 1 wherein said directively marked spaces are arrows.

13. The board game apparatus of claim 1, wherein only certain of said additional plurality of directively marked spaces constituting said at least one second course have stop areas adjacent thereto.

* * * * *